United States Patent [19]

Marsh

[11] 4,096,811

[45] Jun. 27, 1978

[54] INTERLOCK FOR BUTTONHOLE SEWING PRESSER DEVICE

[75] Inventor: Walter H. W. Marsh, Fanwood, N.J.

[73] Assignee: The Singer Company, New York, N.Y.

[21] Appl. No.: 813,568

[22] Filed: Jul. 7, 1977

[51] Int. Cl.[2] ..... D05B 3/24
[52] U.S. Cl. ..... 112/77
[58] Field of Search ..... 112/77, 70, 73, 75, 112/76, 158 B, 235

[56] References Cited

U.S. PATENT DOCUMENTS

| | | | |
|---|---|---|---|
| 3,113,537 | 12/1963 | Bono | 112/158 B |
| 3,656,443 | 4/1972 | Ross | 112/77 |
| 3,877,403 | 4/1975 | Kettener | 112/77 |

*Primary Examiner*—H. Hampton Hunter
*Attorney, Agent, or Firm*—R. E. Smith; E. L. Bell

[57] ABSTRACT

An interlock between the work engaging presser foot and the work engaging shoe of a buttonhole sewing presser device which is effective to prevent travel of the work engaging shoe when the presser foot is raised for work insertion. In addition a latch is provided effective to prevent accidental disengagement of the interlock when the buttonhole sewing presser device tilts after the presser foot has been raised.

4 Claims, 5 Drawing Figures

INTERLOCK FOR BUTTONHOLE SEWING PRESSER DEVICE

BACKGROUND OF THE INVENTION

This invention relates to buttonhole sewing presser devices for sewing machines, particularly of the type employing a traveling shoe which moves with the work fabric relatively to the presser foot during the sewing of the buttonhole. In this type of buttonhole sewing presser device, the position of the traveling shoe is used to indicate or to control the length of the buttonhole being stitched. In order to make a buttonhole of the desired length, therefore, it is necessary for the traveling shoe to occupy the proper starting position at the beginning of the buttonhole sewing and if the traveling shoe is accidentally shifted out of the initial position during insertion of work fabrics, one side of the resulting buttonhole will be too short.

SUMMARY OF THE INVENTION

It is an object of this invention to provide an interlock effective when the buttonhole sewing presser device is raised for work insertion to hold the traveling shoe in the proper starting position. This objective is attained by the provision of a vertical clearance between the presser foot and the traveling shoe and interengaging lugs on the presser foot and traveling shoe which engage when the presser foot is raised.

This invention also provides for a latch effective to maintain the interlock engaged while the presser foot is raised. To this end the center of gravity of the button sewing presser device is arranged offset from the pivoted connection between the presser foot and the presser foot shank so that the buttonhole device will tilt when the presser foot is raised. A pivoted latch keeper which may include shiftable counterweights is provided responsive to tilting of the buttonhole device for latching the interlock in engagement thus to deter inadvertent shift of the traveling shoe during insertion of work in the buttonhole sewing presser device.

DETAILED DESCRIPTION

Figure 1:
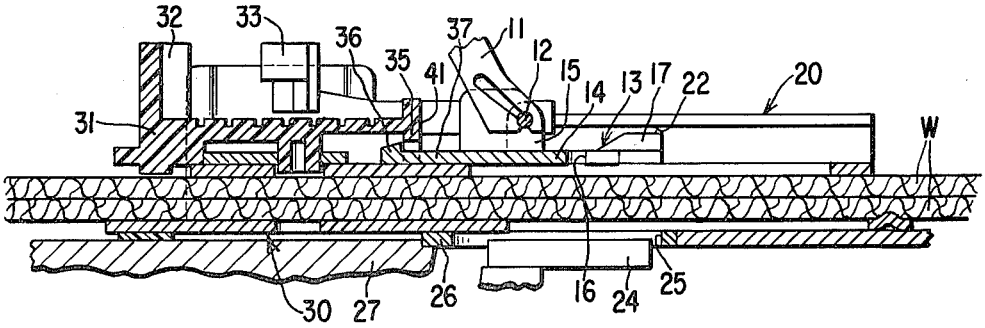
FIG. 1 is a cross-sectional view of the buttonhole sewing presser device having one form of this invention applied thereto and illustrated with fragments of a sewing machine showing the presser foot lowered and the parts positioned in readiness to sew a buttonhole.
Figure 2:
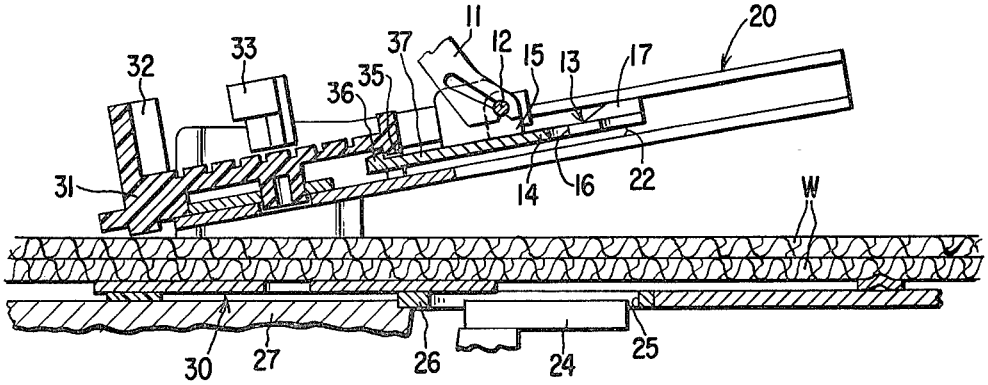
FIG. 2 is a cross-sectional view of the buttonhole sewing presser foot of FIG. 1 illustrated with the presser foot raised.
Figure 3:
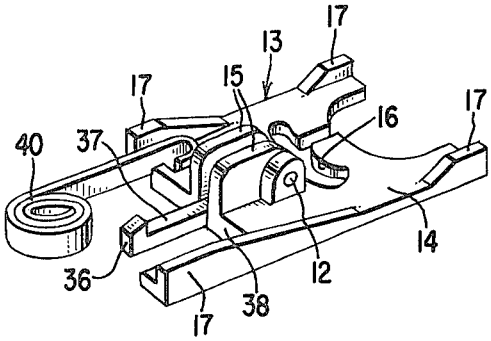
FIG. 3 is a perspective view of the presser foot of the buttonhole sewing presser device.

A preferred embodiment of this invention is illustrated in FIGS. 1, 2 and 3 of the accompanying drawings as applied to a presser device for sewing buttonholes of the type disclosed in the U.S. Pat. No. 3,877,403, Apr. 15, 1975, which is incorporated herein by reference. This buttonhole sewing presser device comprises a presser shank 11 which is secured to a sewing machine presser bar and which engages a pivot pin 12 carried by a presser foot member 13. The presser foot member is best illustrated in FIG. 3 and includes a generally rectangular base plate 14 from which rise spaced tangs 15 which carry the pivot pin 12. The base plate is also formed with a needle accommodating aperture 16 for passage of a sewing machine needle in the formation of the stitches which make up the buttonhole. Upturned flanges 17 at each corner of the base plate 14 serve as guide members along which a traveling shoe member 20 is slidably arranged. The traveling shoe member is formed at each side with a channel 21 each channel embracing the flanges 17 at one side of the presser foot member base plate. As shown in FIGS. 1 and 2, a clearance 22 is provided between the channel 21 and the flanges 17 so that a vertical movement is possible between the presser foot and the traveling shoe members particularly when the buttonhole sewing presser device is elevated as for introduction and removal of work fabrics.

As explained in the U.S. Pat. No. 3,877,403, the traveling shoe member 20 of the buttonhole sewing presser device moves back and forth with the work fabrics W as the work fabrics are transported relatively to the sewing machine during the sewing of the buttonhole by the feed dog 24 of the sewing machine. As illustrated in FIGS. 1 and 2, the feed dog 24 operates upwardly through slots 25 and a throat plate 26 carried on the work supporting bed 27 of the sewing machine to feed the work fabrics lengthwise along the buttonhole during the sewing operation. A work engaging plate 30 is also associated with the traveling shoe member 20 and is moveable with the shoe during the formation of buttonholes. When the presser foot is elevated as shown in FIG. 2, the traveling shoe member 20 will be elevated so that the work fabrics may be inserted or removed between the work engaging plate 30 and the traveling shoe member 20. When the presser foot member is lowered, the parts will assume the positions illustrated in FIG. 1 and the work will be clamped between the traveling shoe member 20 and the work engaging plate 30 in readiness for the sewing of a buttonhole.

Attached to the rear of the traveling shoe member 20 is one half of a button measuring device 31, preferrably formed of a synthetic plastic material and including a button engaging jaw member 32. Slidably constrained opposite the jaw member 32 is a shiftable button engaging jaw member 33 which as explained in the U.S. Pat. No. 3,877,403, carries abutment elements which will be positioned in accordance with the size of a button placed between the jaw members 32 and 33 so as to influence the sewing machine controls during movement of the traveling shoe member 20 to sew a buttonhole of a size suitable to accept the button being gauged.

The button gauging member which is carried by the traveling shoe member 20 includes a depending interlock element 35 which is adapted to cooperate with an upstanding interlock element 36 carried by a projection 37 extending rearwardly from the back wall 38 of the presser foot member base plate 14. A flat coil spring 40 is engaged with the presser foot member 13 as shown in FIG. 3, and is constrained at the opposite extremity in the button gauging portion 31 which is attached to the traveling shoe member 20. The coil spring serves to bias the traveling shoe relatively to the presser foot member into the position as shown in FIGS. 1 and 2 in this extreme spring biased position the back wall 38 of the presser foot base plate 14 and the front surface 41 of the button gauging portion 31 serve as abutment members locating the presser foot and traveling shoe members in one extreme relative position.

In the extreme relative position of the presser foot and traveling shoe members 13 and 20 toward which the spring 40 biases the parts, elevation of the buttonhole presser device by raising of the presser foot members 13 as shown in FIG. 2 will cause the interlock elements 35 and 36 to engage. The interlock elements when engaged prevent movement of the traveling shoe member 20 relatively to the presser foot member during insertion or removal of work fabrics, and therefore when the presser foot is lowered into the position as shown in FIG. 1, the operator of the sewing machine can be assured that the traveling shoe member 20 will begin at the extreme position of the traveling shoe member as dictated by the engaged abutment surfaces 38 and 41. Full travel of the traveling shoe member 20 during the sewing of each leg of the buttonhole will then be assured and formation of perfect buttonholes can be expected with each machine operation. When the presser foot member 13 is lowered into the position as illustrated in FIG. 1, the dimensions of the interlock elements 35 and 36 are such as to provide vertical clearance therebetween as shown clearly in FIG. 1 permitting free travel of the shoe member 20 relatively to the presser foot member 13.

Figure 4:
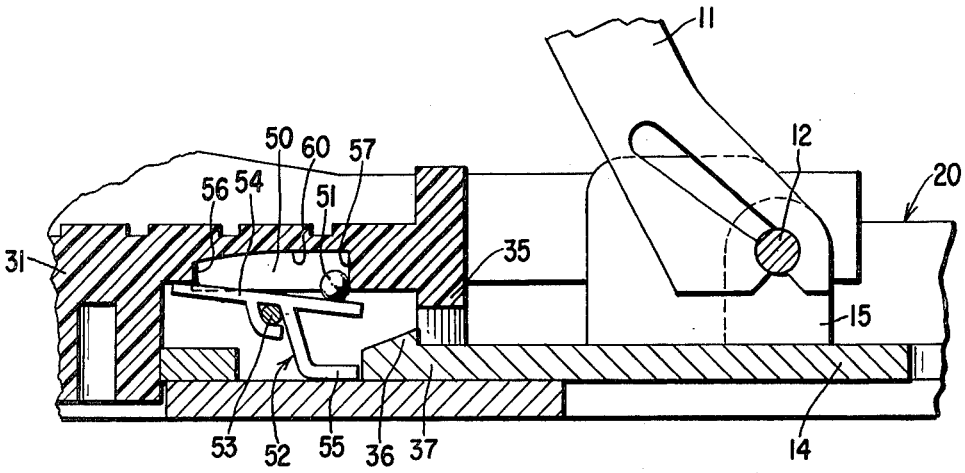
FIG. 4 is an enlarged cross-sectional view of portions of a buttonhole sewing presser foot having a modified form of this invention applied thereto illustrated with the presser foot lowered.
Figure 5:
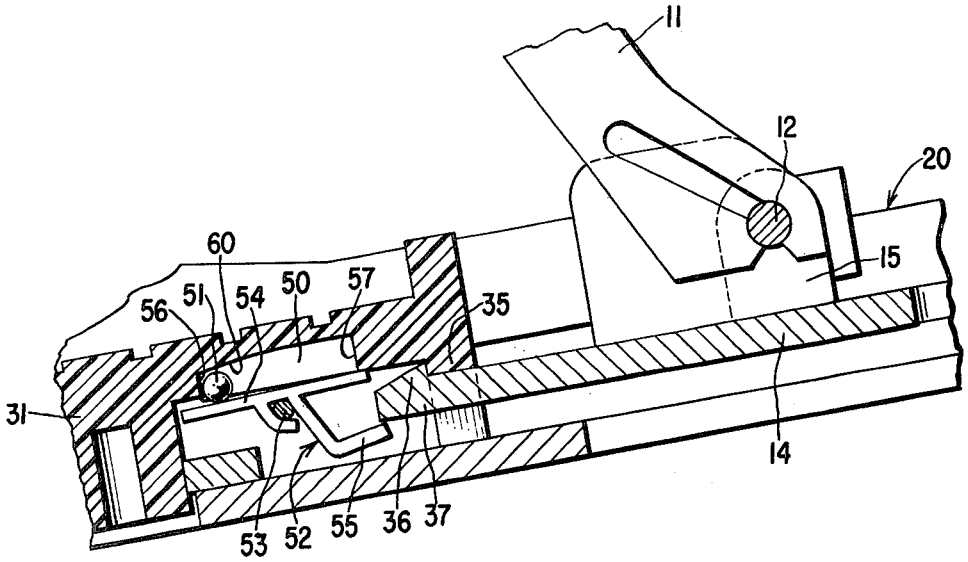
FIG. 5 is an enlarged cross-sectional view of the portions of a buttonhole sewing presser foot of FIG. 3 illustrated with the presser foot raised.

FIGS. 4 and 5 illustrate a modified form of the construction illustrated in FIGS. 1, 2 and 3. It will be appreciated that the modification shown in FIGS. 4 and 5 includes the identical interlock elements 35 and 36 which are included in the construction illustrated in FIGS. 1 and 2, and in addition, the modification of FIGS. 4 and 5 includes a further interlock device which is effective to latch the interlock elements 35 and 36 into engaged condition whenever the presser foot member is elevated so as to prevent inadvertent disengagement of the interlock elements 35 and 36 as, for instance, by the sewing machine operator's handling of the fabrics during insertion into the buttonhole presser device.

As shown in FIGS. 4 and 5, the button engaging portion 31 which is attached to the traveling shoe member 20 is formed rearwardly of the front surface 41 thereof with a recess 50 in which a spherical counterweight element 51 is disposed. A latch member 52 is pivotably supported on a pin 53 beneath the recess 50 and the latch member 52 preferrably comprises a supporting track element 54 along which the spherical counterweight element is adapted to roll. Depending from the supporting track 54 the latch member 52 is formed with a latch arm 55 adapted when the latch member is turned in a counterclockwise direction as illustrated in FIG. 5 to occupy a position beneath the projection 37 on the presser foot member so as to maintain the interlock elements 35 and 36 in engaged relation as shown in FIG. 5. In the position of parts illustrated in FIG. 5, it will be appreciated that forces applied to the buttonhole sewing presser device by insertion of fabrics by the operator can have no effect in inadvertently disengaging the interlock elements 35 and 36.

The button gauging parts 31 and 32 carried rearwardly of the presser foot member 13 on the traveling shoe member 20 provide a weight distribution of the traveling shoe member 20 which places the center of gravity of the traveling shoe member rearwardly of the presser foot member 13. Whenever the presser foot member 13 is raised, therefore, the buttonhole sewing presser device will tilt with the rearward portion assuming a lower position than the toe portion as shown in FIG. 5. In this tilted position which the buttonhole sewing presser device occupies when raised, the supporting track 54 of the latch member 52 will similarly assume an inclined position in which the rearmost extremity is lowest influencing the spherical counterweight 51 to roll toward the rearward extremity 56 of the recess 50 which will cause the latch member to turn in a counterclockwise direction as shown in FIG. 5. Similarly lowering of the buttonhole sewing presser device will cause the traveling shoe member 20 to assume a position parallel with the work supporting bed of the sewing machine and this will turn the supporting track 54 of the latch member in a clockwise direction into a position in which the forward extremity is lowest. This inclination of the supporting track will cause the spherical counterweight element to roll toward the forward extremity 57 of the recess influencing the latch member to turn into the position shown in FIG. 4 releasing the interlock elements 35 and 36. The traveling shoe member may then shift relatively to the presser foot member 13 and a buttonhole may be formed in the usual manner.

The roof 60 of the recess 50 is preferrably arched so that in the position of parts shown in FIG. 5 when the latch member is turned by the counterweight 51 to retain the interlock elements 35 and 36 engaged, the latch member cannot be released by forces acting to separate the interlock elements. Only by leveling the buttonhole sewing presser device and causing the counterweight to shift to the forward extremity of the recess can the latch member be released.

Having thus set forth the nature of the invention, what is claimed herein is:

1. In a buttonhole sewing presser device of the type having a work engaging presser foot member, a traveling shoe member, means shiftably supporting said traveling shoe member on said presser foot member for movement with the work being sewn relatively to the presser foot member, stop means defining one extreme relative position between said members, and spring means biasing said traveling shoe member toward said extreme position defined by said stop means, the improvement which comprises clearance between the means shiftably supporting said traveling shoe member on said presser foot member permitting a predetermined amount of relative movement vertically between said members when the presser device is elevated, and cooperating interlock elements carried respectively on said presser foot member and on said traveling shoe member for preventing travel of said traveling shoe member relatively to said presser foot member, and said interlock elements being arranged for engagement when the presser device is elevated and the traveling shoe member occupies a position abutting said stop means.

2. In a buttonhole sewing presser device as set forth in claim 1, in which said interlock elements are arranged out of engagement and with a vertical clearance therebetween when the presser device is lowered onto the work being sewn to free the work engaging shoe for travel relatively to the presser foot member.

3. In a buttonhole sewing presser device as set forth in claim 1, in which the presser foot member is pivotably connected with a shank member by which the presser device is attached to a sewing machine, in which the center of gravity of the presser device is arranged rearwardly of said pivotal connection of the presser foot member causing said presser device to tilt whenever the presser device is elevated, in which a latch keeper is initially supported on said traveling shoe and is responsive to said tilting of said presser device to latch the interlock elements in engagement.

4. In a buttonhole sewing presser device as set forth in claim 3, in which a shiftable counterweight is associated with said pivoted latch keeper and is effective in response to tilting of said presser device to urge said latch keeper into a position for maintaining said interlock elements in engagement, and is effective in response to leveling of said presser device to urge said latch keeper out of position for maintaining said interlock elements in engagement.

* * * * *